US008657136B2

(12) United States Patent
Adler et al.

(10) Patent No.: US 8,657,136 B2
(45) Date of Patent: Feb. 25, 2014

(54) CHILD RESISTANT BULK DOSE DISPENSING UNIT

(75) Inventors: Ari Tao Adler, Cambridge, MA (US); Robert John McCaffrey, Hillsborough, NH (US)

(73) Assignee: Wyeth LLC, Madison, NJ (US)

( * ) Notice: Subject to any disclaimer, the term of this patent is extended or adjusted under 35 U.S.C. 154(b) by 653 days.

(21) Appl. No.: 12/728,482

(22) Filed: Mar. 22, 2010

(65) Prior Publication Data

US 2011/0226772 A1 Sep. 22, 2011

(51) Int. Cl.
*B65D 50/02* (2006.01)

(52) U.S. Cl.
USPC ..... 215/201; 220/348

(58) Field of Classification Search
USPC ..... 220/345.1, 345.2, 345.3, 350, 351, 315, 220/345.4, 811, 812, 813, 348; 215/201, 215/209, 221, 322, 301, 216, 280, 287; 206/528, 540
See application file for complete search history.

(56) References Cited

U.S. PATENT DOCUMENTS 3,782,584 A * 1/1974 Swenson et al. ..... 220/345.3
4,561,544 A 12/1985 Reeve
5,082,137 A 1/1992 Weinstein
6,006,941 A 12/1999 Hitchings et al.
6,036,036 A * 3/2000 Bilani et al. ..... 215/216
D449,782 S 10/2001 Diaz
6,367,639 B1 4/2002 Mar
D464,884 S 10/2002 Sumpmann et al.
6,866,164 B2 3/2005 Branson et al.
7,114,619 B2 10/2006 Ellis et al.
7,296,711 B2 11/2007 Hayakawa et al.
7,370,773 B2 5/2008 Toth et al.
7,413,083 B2 8/2008 Belfance et al.
7,467,727 B2 12/2008 Yuhara
2006/0000833 A1 1/2006 Boots et al.
2006/0138145 A1 * 6/2006 Toth et al. ..... 220/345.2
2007/0284372 A1 * 12/2007 Gnepper ..... 220/4.21

FOREIGN PATENT DOCUMENTS

EP 0609955 B1 4/1998
EP 0854963 B1 7/2004
WO WO 01/15998 A1 3/2001

* cited by examiner

*Primary Examiner* — Jeffrey Allen
(74) *Attorney, Agent, or Firm* — Jeffrey Gold; Joseph F. Reidy

(57) ABSTRACT

Child-resistant bulk dose dispensing packaging unit, and a method for opening the packaging unit, including a container and a lid engaged with the container. The container includes a reservoir, an aperture at a top end of the reservoir, and a protrusion extending from a surface of the container. The lid engages with the container and slides between a closed position and an open position. The lid includes a top wall, a side wall extending down from an outer edge of the top wall, and a post configured to engage the protrusion at a first position when the lid is closed so as to keep the lid closed.

8 Claims, 16 Drawing Sheets

FIG. 6D
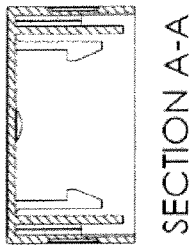
FIG. 6E
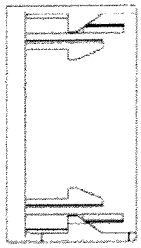
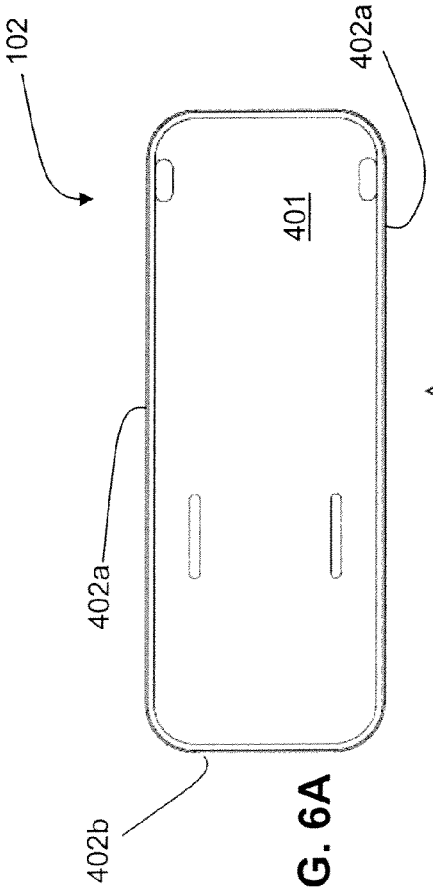
FIG. 6A
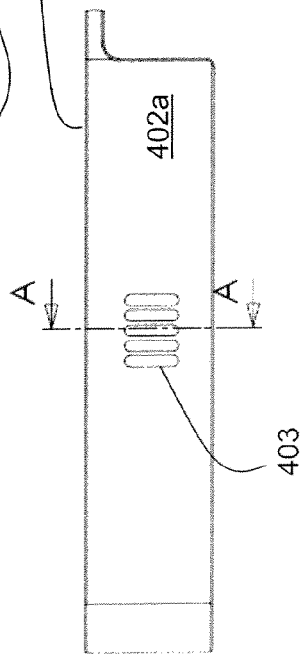
FIG. 6B
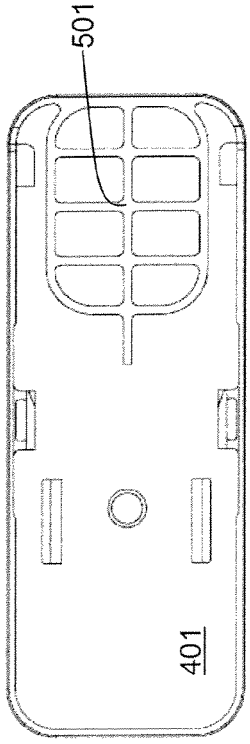
FIG. 6C

CHILD RESISTANT BULK DOSE DISPENSING UNIT

FIELD

This invention pertains to an innovative child-resistant bulk dose dispensing packaging unit, and in particular to a child-resistant packaging unit that includes an opening mechanism activated by simultaneously pressing in a first direction and sliding in a second direction.

BACKGROUND

A child-resistant packaging unit is used to store a dispensable product in a protected manner such that the product can be dispensed by an intended user, yet be safeguarded against dispensing of the product by a child. The dispensable product (e.g., a medicine, supplement, herbal remedy, etc.) in tablet, caplet, capsule or powder form could be hazardous if ingested in uncontrolled quantities. The child-resistant packaging unit incorporates features that discourage or prevent children from opening the unit. The child-resistant packaging unit often takes the form of a container device moveably coupled to a closure member. The closure member may be moved and/or removed from the container device in order to dispense the dispensable product.

Certain designs of a child-resistant packaging unit are known in the art. U.S. Pat. No. 7,730,773 describes a child resistant, moveable closure member and container device and an overcap and container device. The overcap has opposed end walls and opposed sidewalls, with at least one leading locking pin and at least one trailing locking pin in at least one of said sidewalls. The inner closure may have at least one guiding bar, which extends downwardly from its lower surface, that is compatible in shape with an opening slot that may be in at least one of the sidewalls along the upper body of the container. The container further has a fixed cover portion facing the inner closure with a dispensing opening therethrough. At least one of the container sidewalls may have a closing notch, a stopping notch distal to the closing notch, and an opening notch therebetween. When the moveable closure is in the operative closure position, at least one of the leading locking pins is removably engaged in one of the closing notches and at least one of the trailing locking pins is removably engaged in at least one of the open notches, and the at least one guiding bar lies in the opening slot of the container. As the moveable closure is moved to its operative open position, the guiding bar engages and slidably travels along the opening slot. When the moveable closure is in its operative open position, at least one of the leading locking pins is removably engaged in one of the open notches and at least one of the trailing locking pins is removably engaged in one of the stopping notches.

U.S. Pat. No. 7,114,619 claims a package containing and dispensing medicine. The package includes a plug fixed to the package adjacent an open end. The plug has an access opening for enabling removal of material from the container through the open end of the package. A slide is supported on the plug for sliding movement in a first direction relative to the plug between a closed position in which the slide covers the access opening and an open position in which the access opening is uncovered. A child-resistant feature is interposed between the plug and the slide. The written description describes breaking apart an original seal formed from interconnected rigid members of the closure itself.

U.S. Pat. No. 6,367,639 describes a safety container that incorporates a slidable locking pin with an integral but separately lockable locking tab. The locking pin is internally biased by an integral S-spring which, in cooperation with the lid on the container, urges the pin to slide into a slideway formed in the lid of the container. The locking pin may be locked into a closed position by rotation of the locking tab into a flexed position. In this position, the locking tab cannot slide within a mating slot in the hinge lid and, thus, the locking pin cannot slide into the slideway formed in the lid. Alternatively, the locking tab may be rotated into a non-flexed position in which the locking tab can be urged to penetrate the mating slot in the lid and allow the locking pin to slide into the slideway in the lid. By use of the locking pin, the safety container can be set to require the user to perform distinct hand motions in order to open the container.

SUMMARY

One or more embodiments of the present invention may provide a packaging unit, and a method for opening the packaging unit, such that the packaging unit includes a container and a lid engaged with the container. The container includes a reservoir configured to hold contents to be dispensed, an aperture disposed at a top end of the reservoir, in which the aperture is operable to dispense the contents, and a protrusion extending from a surface of the container. The lid is engaged with the container and slideable along a first direction between a closed position in which the lid covers the aperture of the container and an open position in which the aperture is substantially uncovered. The lid includes a top wall, a side wall extending down from an outer edge of the top wall, and a post configured to engage the protrusion at a first position when the lid is in the closed position so as to limit opening of the lid along the first direction, at least a portion of the post extending substantially parallel to the side wall at a distance from the side wall. The post is further configured such that a deflection of the side wall by an inward force places the post at a second position, wherein at the second position the post is disengaged from the protrusion.

One or more embodiments of the present invention may provide a packaging unit, and a method for opening the packaging unit, such that the packaging unit includes a container and a lid engaged with the container. The container includes a reservoir configured to hold contents to be dispensed, an aperture disposed at a top end of the reservoir, wherein the aperture is operable to dispense the contents, and a flexible arm disposed on a top surface of the reservoir, the flexible arm having a pivot end, a moveable end opposite from the pivot end, the moveable end having a blunt vertical end face, and an inclined upper surface joining the pivot end and the moveable end, wherein the moveable end is vertically moveable between a resting position and a depressed position. The lid is engaged with the container and slideable along a first direction between a closed position in which the lid covers the aperture of the container and an open position in which the aperture is substantially uncovered. The lid includes a top wall configured to block the aperture when the lid is in the closed position, the top wall including a flexible portion and a substantially rigid portion, a stopping post extending down from the substantially rigid portion of the lid, to a position below the resting position of the moveable end of the flexible arm, the stopping post located so as to engage with the moveable end of the flexible arm when the moveable end is in the resting position, and a protrusion extending down from the flexible portion of the top wall, the protrusion configured to engage the flexible arm.

One or more embodiments of the present invention may provide a packaging unit, and a method for opening the packaging unit, such that the packaging unit includes a container and a lid engaged with the container. The container includes a reservoir configured to hold contents to be dispensed, an aperture disposed at a top end of the reservoir, wherein the aperture is operable to dispense the contents, and a flexible arm disposed on a top surface of the reservoir, the flexible arm having: a pivot end; a moveable end opposite from the pivot end, the moveable end having an enlarged portion, wherein the moveable end is horizontally moveable between a resting position and a depressed position. The lid is engaged with the container and slideable along a first direction between a closed position in which the lid covers the aperture of the container and an open position in which the aperture is substantially uncovered. The lid includes a top wall, a side wall extending down from an outer edge of the top wall, and an aperture formed in the side wall, the aperture sized and positioned to engage the enlarged portion of the moveable end of the flexible arm when the lid is in the closed position.

BRIEF DESCRIPTION OF DRAWINGS

Features illustrated in the figures are not drawn to scale unless explicitly stated otherwise, and the relative sizes of certain features may be exaggerated to better illustrate the features. Embodiments will be described with reference to the following figures, in which like numerals represent like items throughout the figures, and in which:

FIG. 6A shows a top view of a lid in accord with the embodiment of FIG. 4;

FIG. 6B shows a left side view of the lid of FIG. 6A;

FIG. 6C shows a bottom view of the lid of FIG. 6A;

FIG. 6D shows a sectional view of the lid of FIG. 6B;

FIG. 6E shows a front view of the lid of FIG. 6B;

DETAILED DESCRIPTION

A child-resistant bulk dose dispensing packaging unit embodying the present invention includes a container section and a slideable lid that covers the container. When the lid is in a closed position, the bulk dose dispensing packaging unit has an elongated cross-sectional shape in a horizontal plane. As an example, the shape may be that of a continuous rectangular box without any projections around the interface between the lid and the container. The height and the length of the box are of comparable dimension, while the width is substantially smaller. The edges at the top and bottom surfaces of the box may be relatively sharp, while the edges along the sides (i.e., running from the top to the bottom), may be curved. The lid is generally disposed above the container and opens by sliding along its length, as explained in more detail below. However, the invention is not so limited and includes other configurations, proportions, and implementations, such as round, oval, racetrack or other sections as some embodiments.

As used throughout herein, a major axis is an axis along the length of the cross-sectional shape. A minor axis is a relatively shorter axis across the width of the cross-sectional shape, substantially perpendicular to the major axis. Lateral refers to a direction parallel to the minor axis, unless the context clearly indicates otherwise. Forward or front refers to the end of the child resistant bulk dose dispensing package that is closer to the closable opening. Backwards or rear refers to the end of the child resistant bulk dose dispensing package that is farther from the closable opening. Left and right are as viewed in the orientation facing from the front toward the rear, unless the context clearly indicates otherwise. A travel axis is parallel to the major axis, unless the context clearly indicates otherwise.

Figure 1:
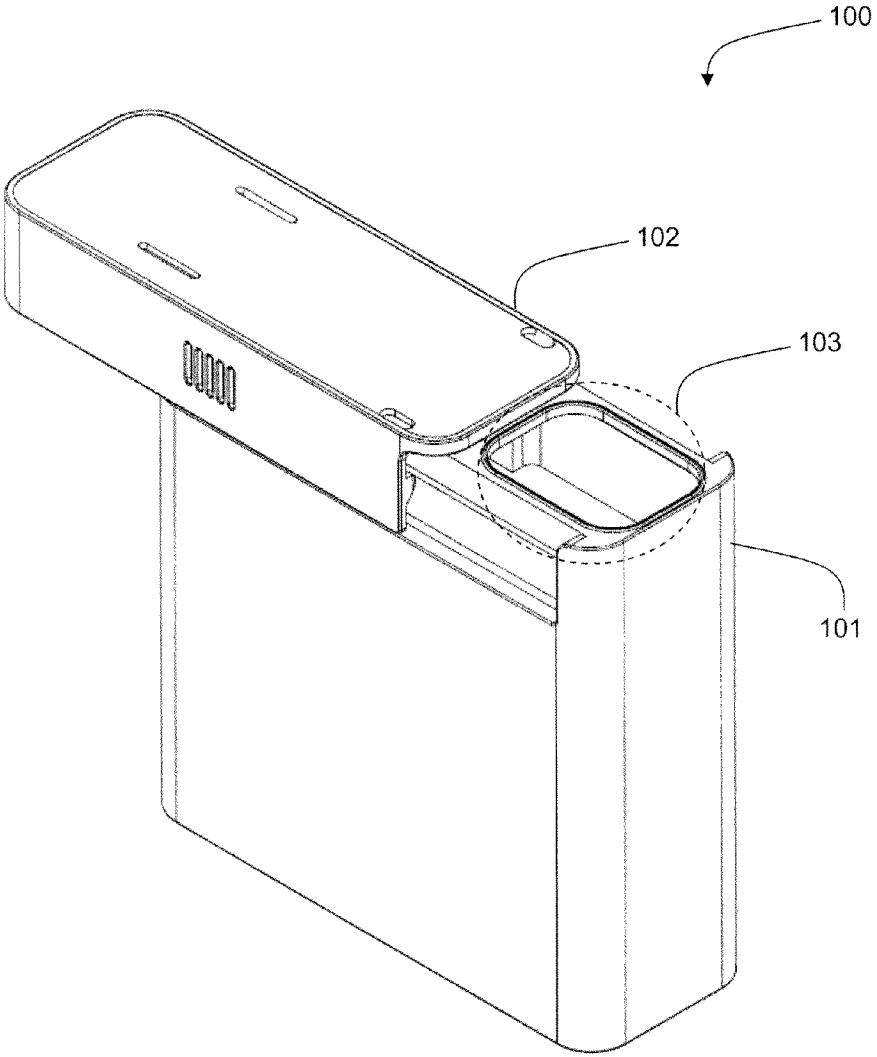
FIG. 1 shows a top front left perspective view of an embodiment of a child-resistant packaging unit in an open position.

FIG. 1 shows a top front left perspective view of an embodiment of a child-resistant bulk dose dispensing packaging unit 100 in an open position. Child-resistant bulk dose dispensing packaging unit 100 may also be referred herein as packaging unit 100. Packaging unit 100 includes a container 101 and lid 102. Lid 102 slidably engages with container 101 in order to selectively cover or uncover aperture 103, in whole or in part. Lid 102 is constructed of a resilient material or includes a flexible portion where a surface is capable of being bowed when opposing forces are applied along the minor axis of lid 102, e.g., as provided by finger pressure. The engagement and operation of lid 102 with container 101 is described below in greater detail.

Figure 2:
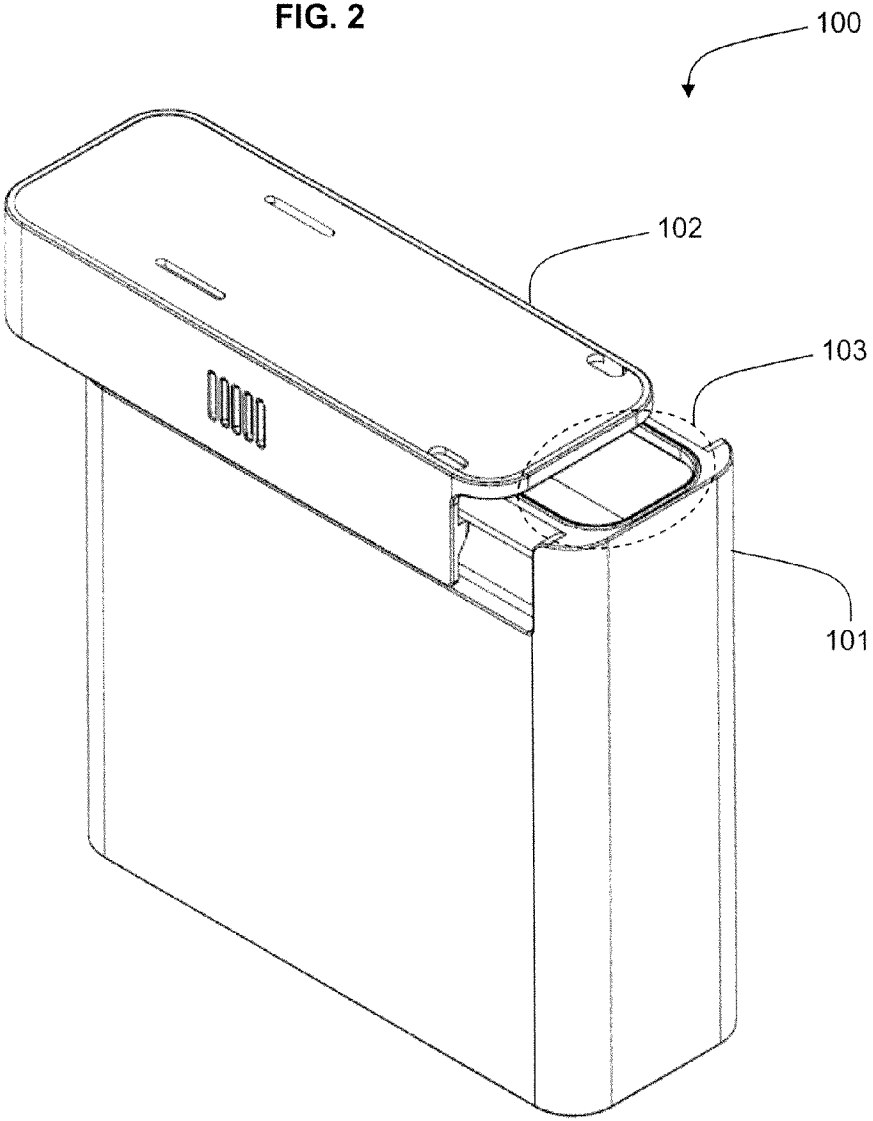
FIG. 2 shows a top front left perspective view of the embodiment of FIG. 1 in a partially closed position.

Referring now to FIG. 2, there is shown a top front left perspective view of an embodiment of a child-resistant bulk dose dispensing packaging unit 100 after lid 102 has been slid to a partially closed position.

Figure 3:
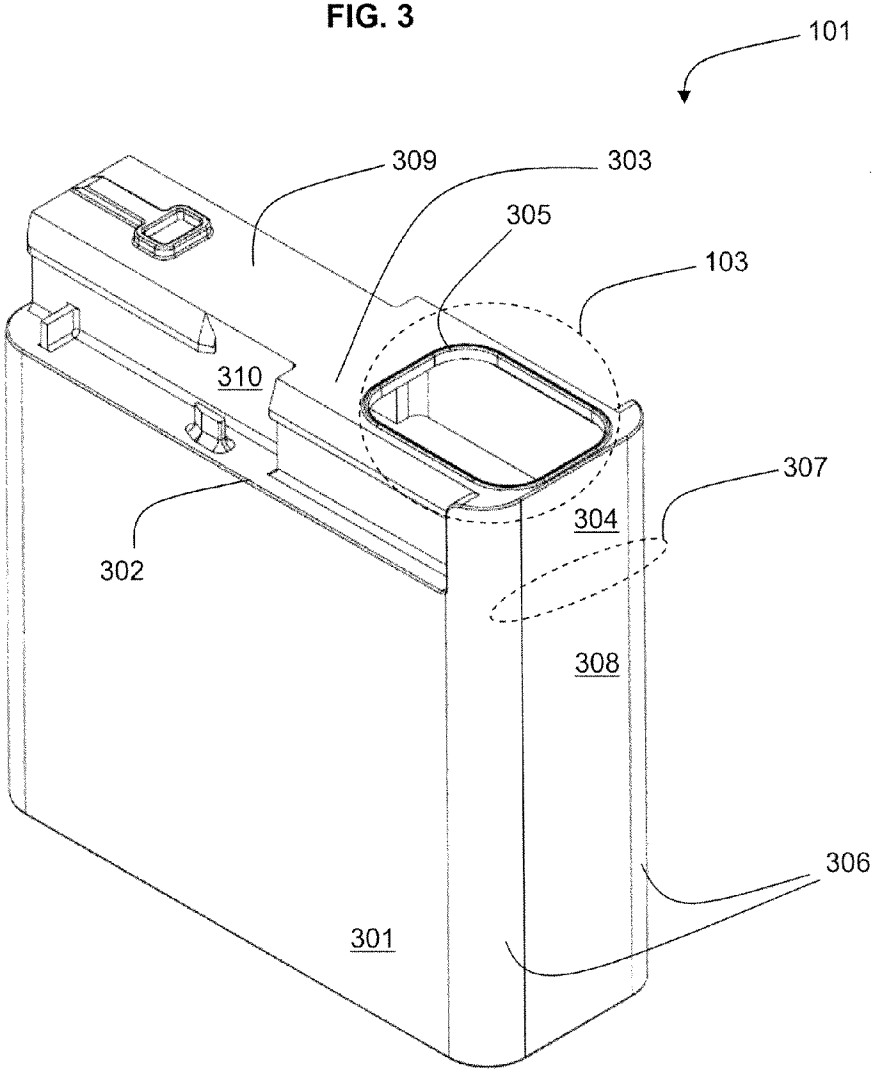
FIG. 3 shows a top front left perspective view of a container in accord with the embodiment of FIG. 1.

Referring now to FIG. 3, there is shown a top front left perspective view of an embodiment of the container 101. The container 101 includes a reservoir 301 that extends from the bottom upwards along the majority of the height of the packaging unit 100. The reservoir 301 ends at a horizontal interface 302 where the outer surface of the lid 102 meets the outer surface of the container 101.

Above the reservoir 301, the container 101 includes a spout 303 having an aperture 103 therethrough for delivering the contents of the packaging unit. The spout 303 is disposed at a front side 304 of the container 101 and is optionally defined by an annular wall 305 that depends from surface 309. In one embodiment the surface 309 and the annular wall 305 are flat. In another embodiment, the surface 309 and the annular wall 305 are angled.

Figure 5:
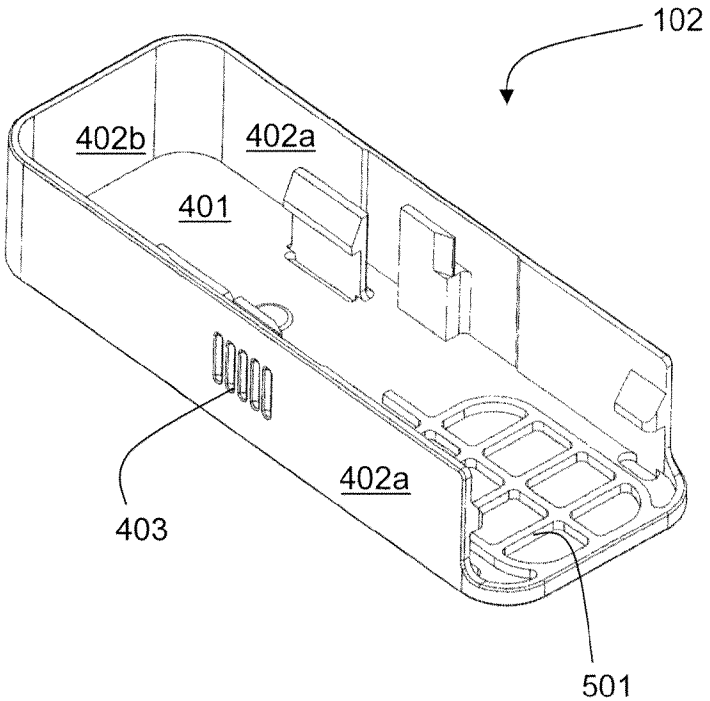
FIG. 5 shows a bottom perspective view of a lid in accord with the embodiment of FIG. 4.
Figure 4:
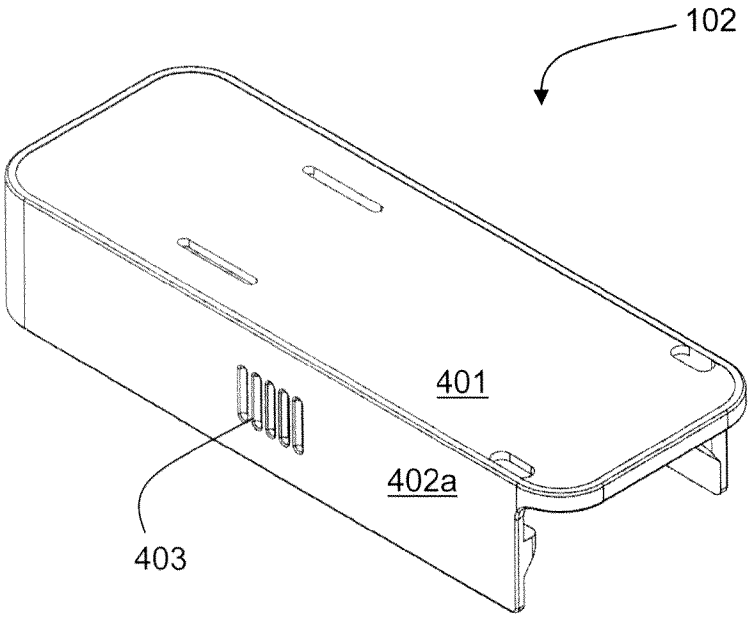
FIG. 4 shows a top front left perspective view of a lid in accord with the embodiment of FIG. 1.

Referring now to FIG. 4, there is shown a top front left perspective view of an embodiment of lid 102. FIG. 5 shows a bottom perspective view of an embodiment of lid 102 that is turned upside down. FIG. 6A shows the top of lid 102. FIG. 6B shows the left side of lid 102. FIG. 6C shows the bottom of lid 102. FIG. 6D is a sectional view of lid 102 along axis A-A defined in FIG. 6B. FIG. 6E shows the front of lid 102. The lid 102 includes a top surface 401 that forms the top of the packaging unit 100. Lid 102 covers the spout 303 when lid 102 is in a closed position. Side walls 402*a* extend down from the left and right sides of the top wall 401. Side wall 402*b* extends down from the rear side of the top wall 401. Optionally, ridges 403 are an outer surface feature that provide an indication to a user of where to squeeze lid 102 when opening packaging unit 100, as described in further detail below. Ridges 403 may protrude outward from surface 402*a*, or may protrude inward into surface 402*a*. Ridges 403 may be implemented as other kinds of surface features such as knurling, slits, rubberized spot, coloration, being slightly elevated or depressed, some material change or the like, such that a user has a tactile and/or visual indication of where to squeeze lid 102. Optionally, ribbing 501 may be patterned on either the inner or outer side of top surface 401 in order to provide additional rigidity to top surface 401 at a location corresponding to aperture 103 when the lid 102 is in a closed position. In one embodiment, the ribbing can be created out of a second material or as part of the same material of the base part of lid 102.

In a closed position, side walls 402*a* and 402*b* of lid 102 hide the three sides of the spout 303 and the mechanisms, described below, that interface with container 101. Thus, the side walls 402*a* extend down to meet the top of the reservoir 301. The front side 304 of the spout 303 forms a portion of the outer surface of the packaging unit 100 including rounded front corners 306. There is a smooth transition 307 between the front side 304 of the spout 303 and the front 308 of the reservoir 301. Front 308 and front side 304 may have a substantially flat shape as illustrated in FIG. 3, or may be provided with alternate shapes such as a rounded shape which may be more ergonomically pleasing. Similarly, a corresponding rear portion of container 101 may be provided with an ergonomically pleasing shape.

The spout 303 extends across substantially the entire minor axis of the packaging unit 100, but extends along a portion of the major axis. When in a closed position, the top of the spout 303 is adjacent to an underside of the top wall 401 of the lid 102 and the left and right sides of the spout 303 are adjacent to the left and right sides of the skirt. A center bar 309 that is the same height as the spout 303 but thinner than the width of the spout 303 extends back from the spout 303 to the rear end of the packaging unit 100. Accordingly, the left side 310 and right side (not shown in FIG. 3) of the center bar 309 are spaced apart from the left and right side walls 402*a* of lid 102.

Figure 7:
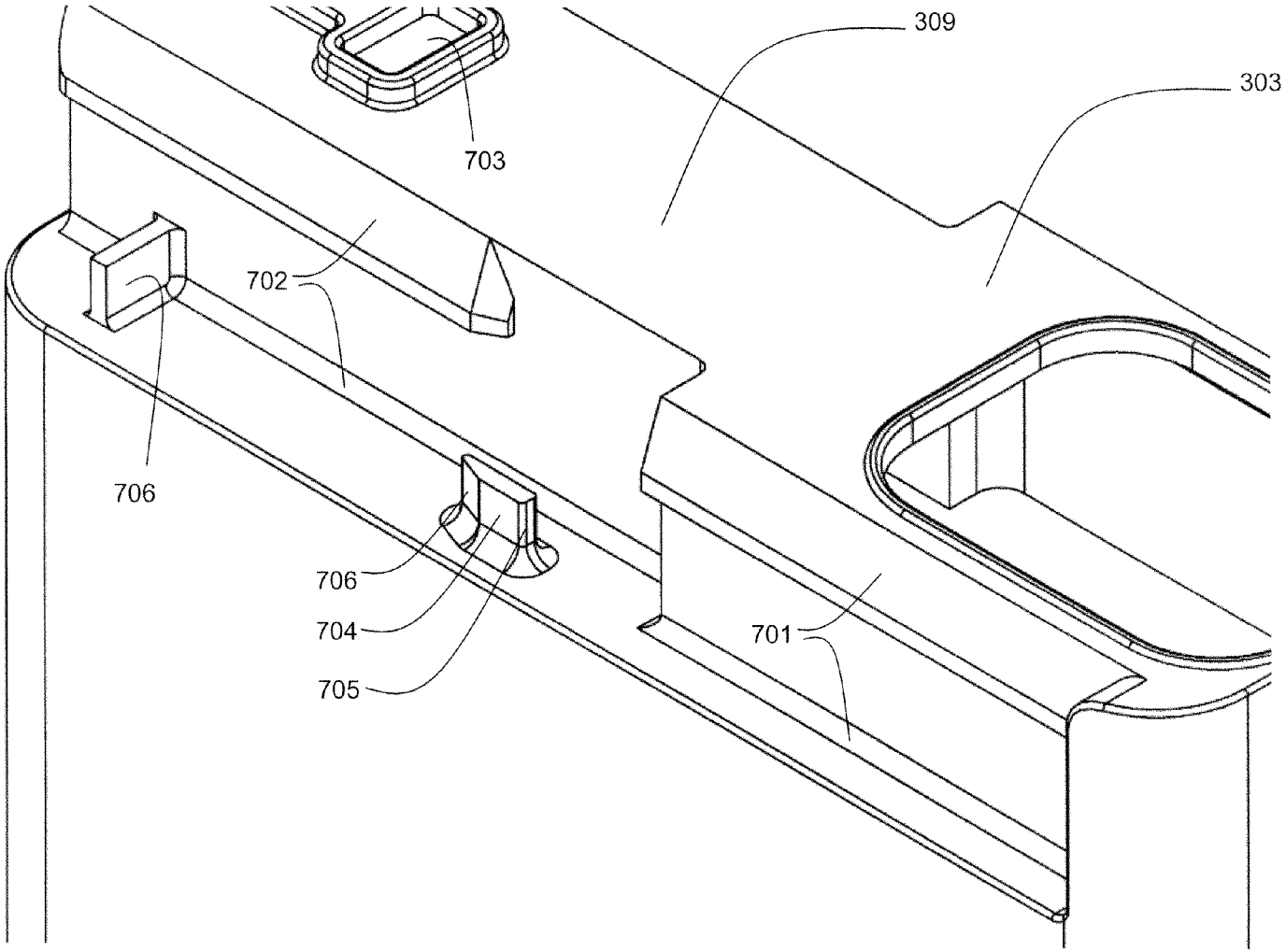
FIG. 7 shows a partial front top left perspective view of the container of FIG. 3.
Figure 8:
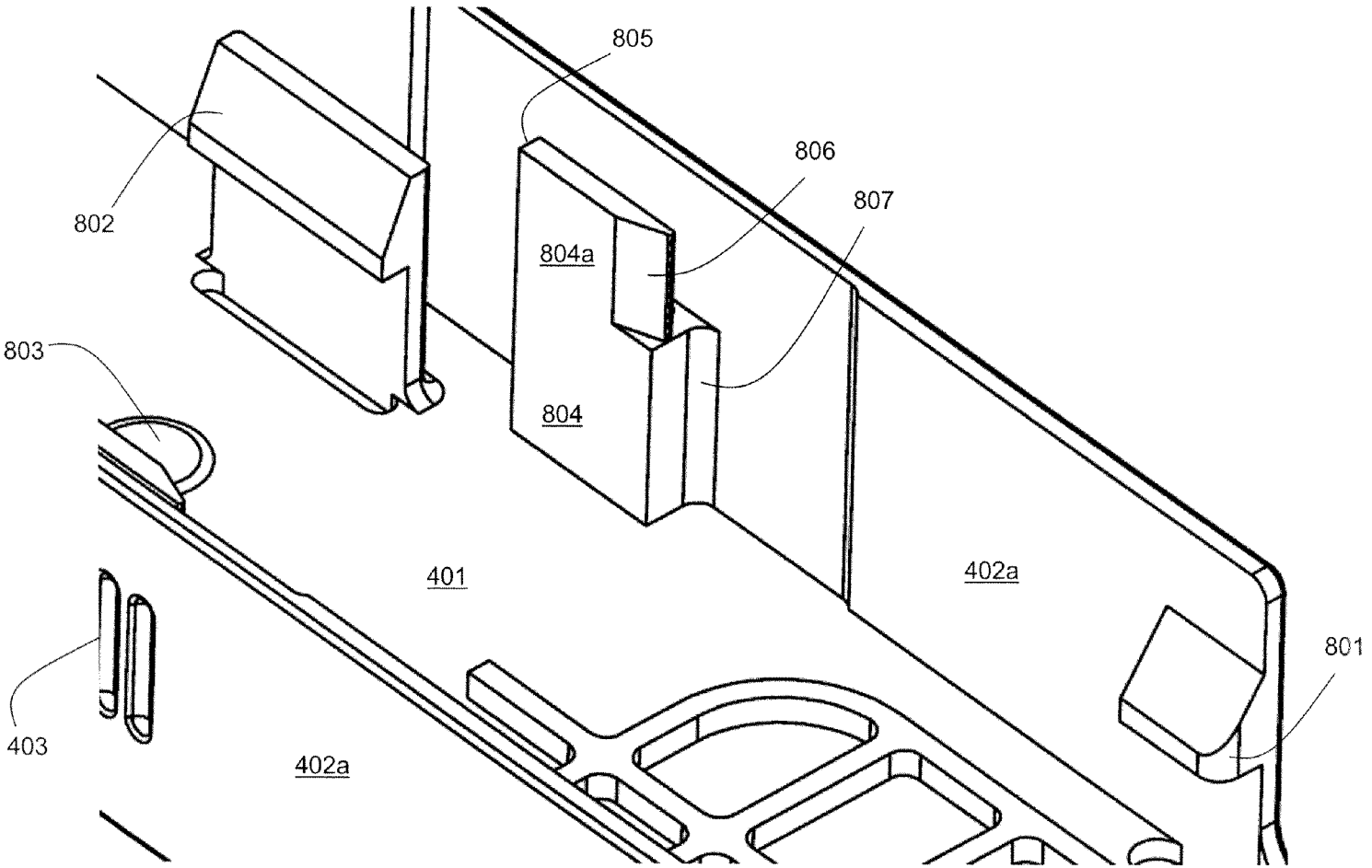
FIG. 8 shows a partial bottom perspective view of the lid of FIG. 5.

Referring now to FIG. 7, there is shown a portion of FIG. 3 which has been expanded in order to refer more easily to select details of container 101. FIG. 8 shows a portion of FIG. 5 which has been expanded in order to refer more easily to select details of lid 102. The left and right sides of the spout 303 each include a rail 701, the left side being illustrated in FIG. 7. FIG. 8 illustrates that a front portion of the left side wall 402*a* includes corresponding slide 801 that cooperates with rail 701 on the spout 303 when lid 102 is upright and attached to container 101. The right side wall 402*a* contains a similar slide 801 (unillustrated in FIG. 8). Although rail 701 is shown as a female shape and slide 801 as a male shape, rail 701 could also be a male shape cooperating with a female-shaped slide 801. Other shapes for the rails are realizable, so long as the rails/slides are horizontally slidable relative to each other, while limiting vertical movement.

Similarly, FIG. 7 illustrates that rear rail 702 is included on a side wall the center bar 309 that communicates with hanging slide 802 (FIG. 8). Hanging slides 802 extend down from a rearward portion of the top wall 401 of the lid 102. Thus, the front of the lid 102 is slidably engaged with the spout 303 via rails 701 and 801, while the back of the lid 102 is slidably engaged with the center bar 309 via the hanging rails 702 and 802.

The top wall 401 of the lid 102 also includes a downward catch 803 that meets a recessed area such as flange 703 disposed on the top of the center bar 309. The flange 703 and catch 803 cooperate so as to limit the distance the lid 102 can slide backward. This distance is set such that the spout 303 opening is uncovered when the lid 102 reaches is rearward sliding limit. A stopper 706 may be provided to engage with hanging slide 804A in order to prevent movement beyond the rearward sliding limit. Catch 803 can be a small feature as shown, or a more substantial feature with a different shape. In one embodiment, catch 803 is a flexible feature.

Alternatively, the flange 703 and catch 803 can be implemented as a locking pin, ratchet, etc., cooperatively matched to one or more notches or indentations. Separate notches or indentations can be used to provide separate positions for the lid 102. For instance, one notch or indentation may correspond to a position at which aperture 103 is at least partially open, and a second position may correspond to a fully open position, or a position beyond which the lid 102 is not designed to slide.

The lid 102 is prevented from sliding rearward by two posts 804 extending down on opposing sides of the center bar 309 from the top wall 401 of the lid 102. One of posts 804 is illustrated in FIG. 8. With the lid 102 in its closed position, an operative portion 804*a* on blunt edge 805 of post 804 is disposed directly in front of a protrusion 704 extending up from a lip on reservoir 301. The lid 102 is prevented from sliding rearward by operative part 804*a* engaging blunt edge 705.

Protrusion 704 is shaped to have a relatively narrow lateral width compared to its length, as illustrated in FIG. 7. Operative portion 804*a* is separated from side 402*a* by a gap at least equal to the lateral width of protrusion 704. Operative portion 804*a* may include one substantially flat or blunt edge 805, and one substantially tapered edge 806. Protrusion 704 may include tapered edge 706. Blunt edges 705, 805 cooperate when lid 102 is in a closed position such that sliding movement is prevented that would otherwise open the packaging unit 100. A linkage 807 is provided that physically interfaces post 804 to side wall 402*a*. Linkage 807 may be provided as a thicker section of post 804 as shown in FIG. 8. Ridges 403 are provided on an outer surface of wall 402*a* at a location that corresponds to or is near the location where post 804 interfaces to the inner surface of wall 402*a* through linkage 807.

The lid 102 is opened by applying inward pressure to the left and right sides 402*a* of lid 102 at the location of ridges 403. Ridges 403 provide tactile indication to a user of where to press sides 402*a*. Sides 402*a* bow inward as they are pressed. Bowing of side 402*a* is transmitted through linkage 807 to post 804. When side 402*a* is sufficiently bowed, post 804 is deflected inward such that operative portion 804*a* no longer engages with protrusion 704. While maintaining this pressure, and the resultant bowing of side 402*a*, lid 102 may be simultaneously slid backwards such that protrusion 704 passes through the gap between operative portion 804*a* and side 402*a*. The amount of bowing of sides 402*a* depends upon the pressure applied by a user, therefore having a gap between operative portion 804*a* and side 402*a* that is wider than the width of protrusion 704 will facilitate a wider range of pressures applied by a user that produces sufficient bowing to allow protrusion 704 to pass through the gap. When pressure is released from ridges 403, the sides 402*a* return from the bowed shape.

To close the packaging unit 100, a user can provide forward force upon any location of lid 102, without the need to squeeze lid 102 at the location of ridges 403. As tapered edges 706, 806 of protrusion 704 and post 804 begin to engage, the tapered shape facilitates operative portion 804*a* to pass by protrusion 704 with little or no need to bow sides 402*a*. Operative portion 804*a*, protrusion 704, and/or side 402*a* may bend slightly as operative portion 804*a* passes protrusion 704. Once operative portion 804*a* fully passes protrusion 704, there may be provided an audible or tactile feedback (e.g., a click) which alerts the user that the packaging unit 100 is in a locked and substantially closed position.

As lid 102 slides back and forth, hanging rails 701, 702, and corresponding slides 801, 802 engage so as to keep lid 102 in a substantially horizontal orientation.

Figures 9A, 9B, 9C, 9D, 9E, 9F:
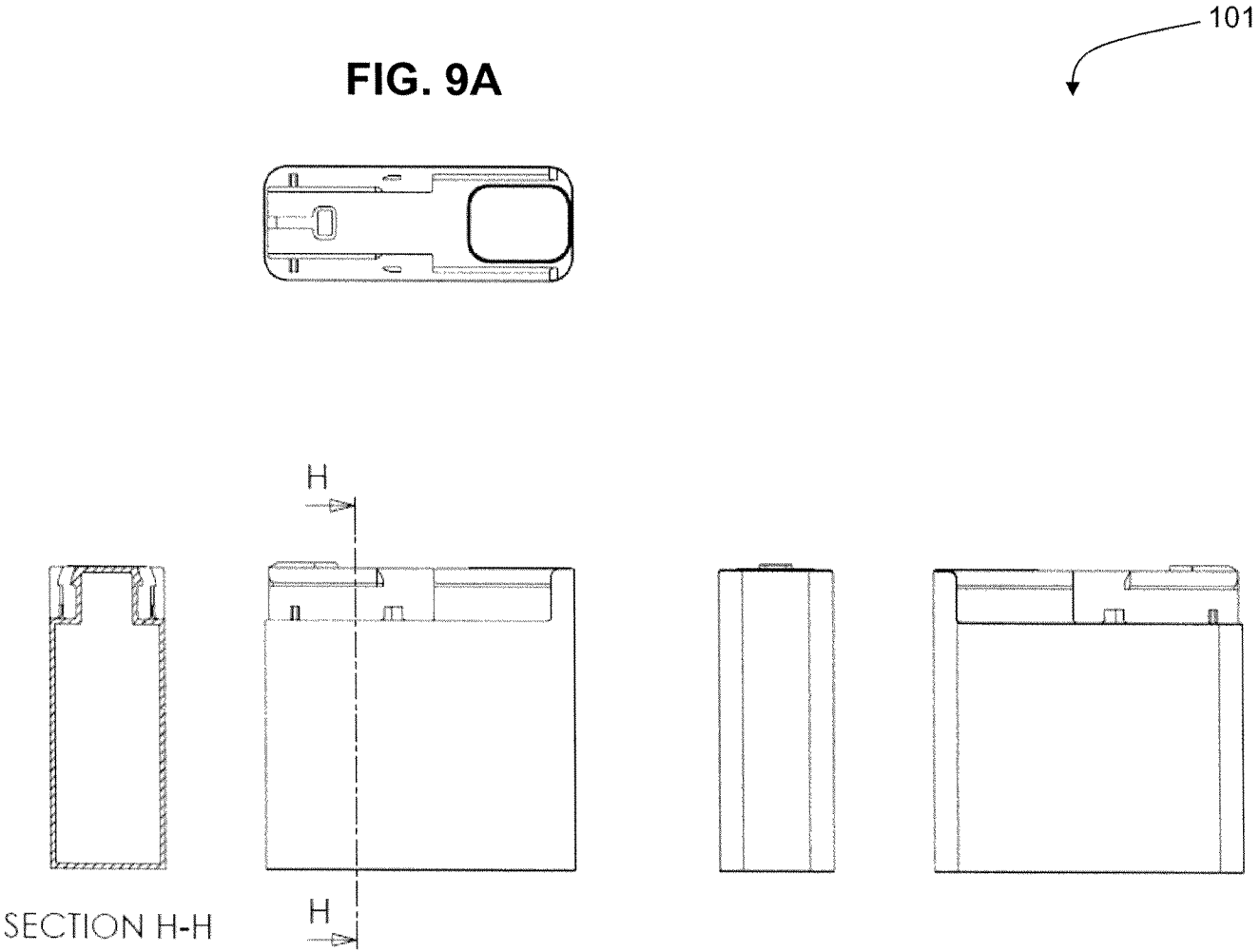
FIG. 9A shows a top view of the container of FIG. 1.
FIG. 9B shows a sectional view along H-H of the container of FIG. 9C.
FIG. 9C shows a left side view of the container of FIG. 9A.
FIG. 9D shows a front view of the container of FIG. 9C.
FIG. 9E shows a right side view of the container of FIG. 9D.
FIG. 9F shows a rear view of the container of FIG. 9E.

FIGS. 9A-9F illustrate various views of a container 101 in accord with one or more embodiments of the invention. FIG. 9A is a top elevational view. FIG. 9C is a left elevational view. FIG. 9B is a sectional view of container 101, cut along axis H-H marked in FIG. 9C. FIG. 9D is a front elevational view. FIG. 9E is a right elevational view. FIG. 9F is a rear elevational view.

Figures 10A, 10B, 10C, 10D, 10E, 10F:
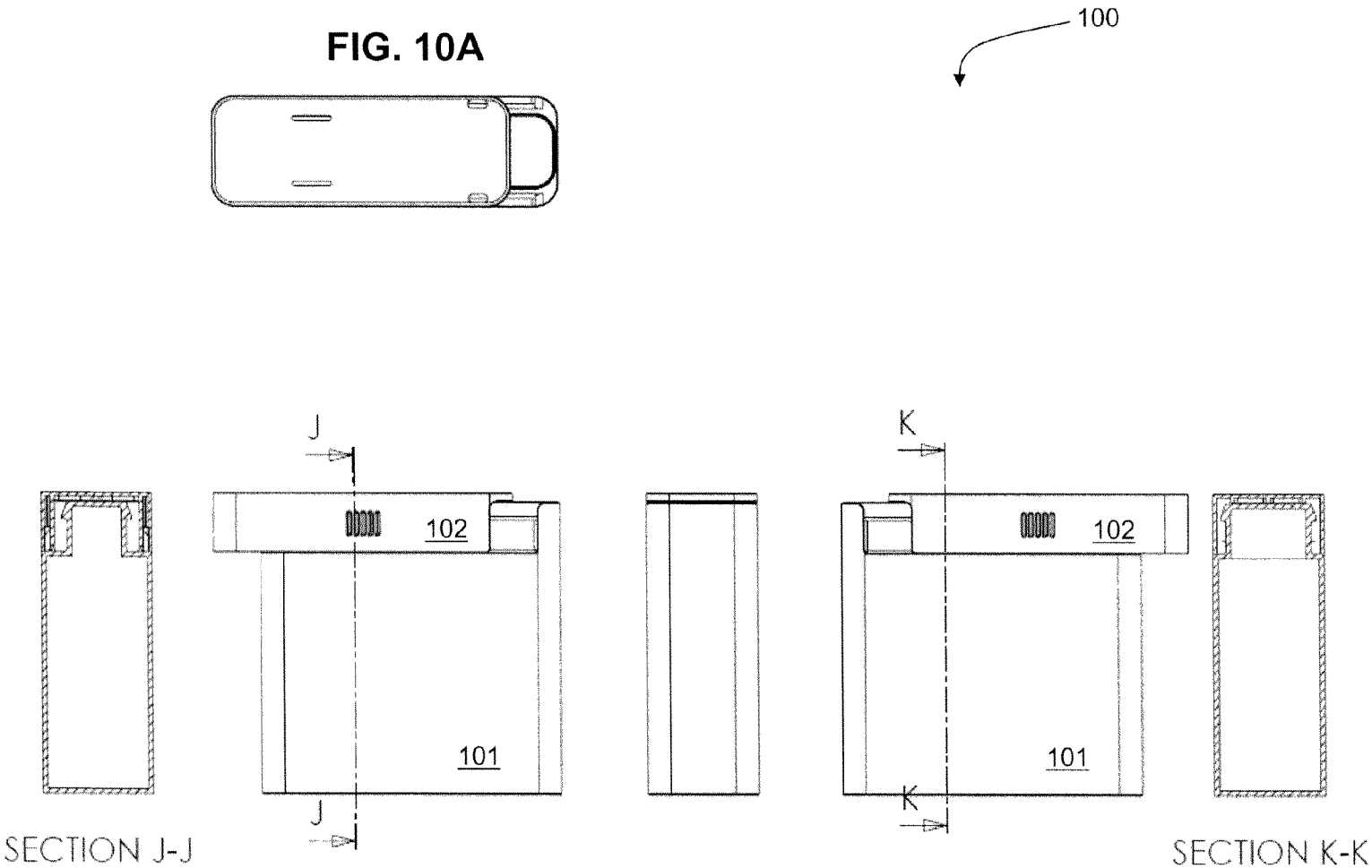
FIG. 10A shows a top view of the child-resistant packaging unit of FIG. 2.
FIG. 10B shows a sectional view along J-J of the child-resistant packaging unit of FIG. 10C.
FIG. 10C shows a left side view of the child-resistant packaging unit of FIG. 10B.
FIG. 10D shows a front view of the child-resistant packaging unit of FIG. 10C.
FIG. 10E shows a right side view of the child-resistant packaging unit of FIG. 10D.
FIG. 10F shows a sectional view along K-K of the child-resistant packaging unit of FIG. 10E.

FIGS. 10A-10F illustrate various views of a packaging unit 100, including container 101 and lid 102, in a partially open position, in accord with one or more embodiments of the invention. FIG. 10A is a top elevational view. FIG. 10C is a left elevational view. FIG. 10B is a sectional view of packaging unit 100, cut along axis J-J marked in FIG. 10C. FIG. 10D is a front elevational view. FIG. 10E is a right elevational view. FIG. 10F is a sectional view of packaging unit 100, cut along axis K-K marked in FIG. 10E.

Figure 11B:
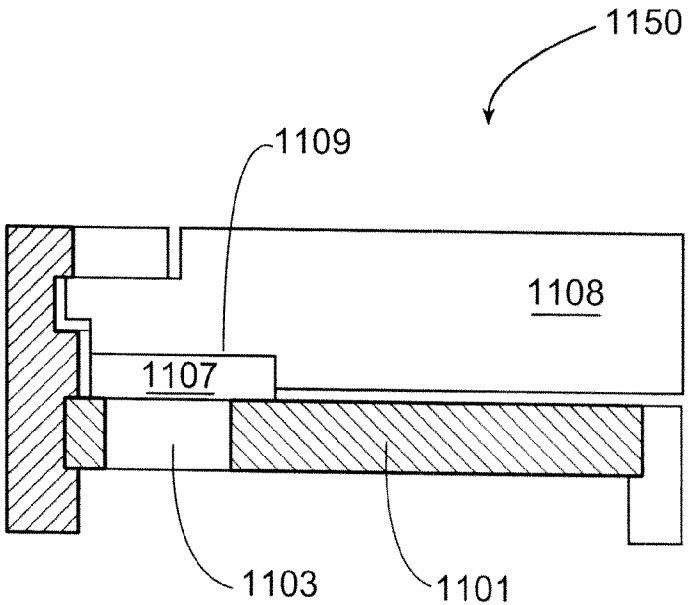
FIG. 11B shows a sectional view in a closed position of an embodiment of a child-resistant packaging unit.
Figure 11A:
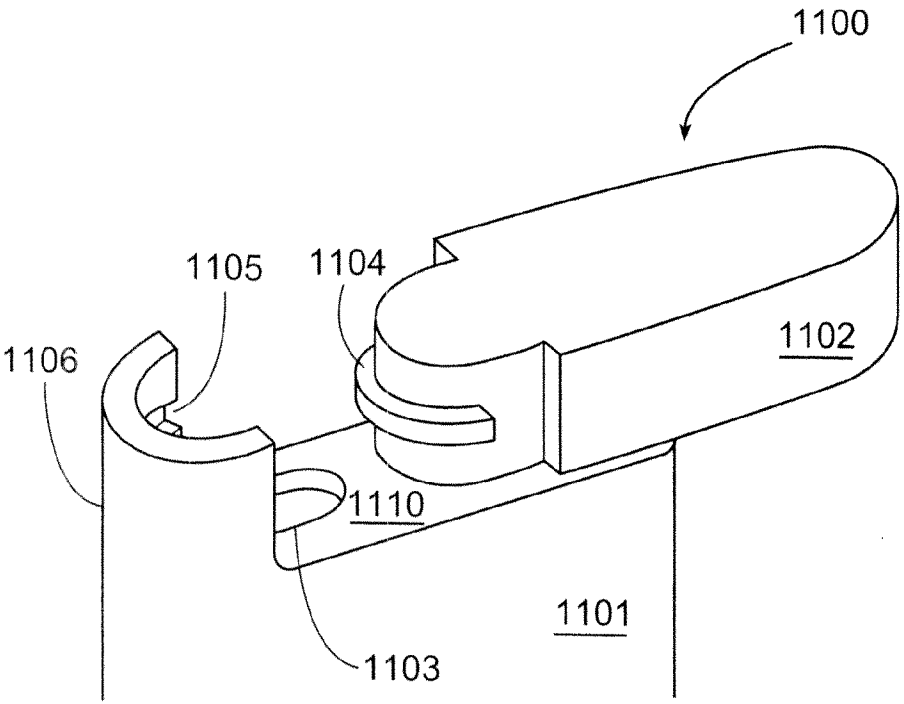
FIG. 11A shows a top front right perspective view in an open position of an embodiment of a child-resistant packaging unit in accord with the invention.

FIG. 11A illustrates an alternate embodiment of a packaging unit 1100. Packaging unit 1100 includes a container 1101 and a lid 1102. Lid 1102 slides over container 1101, along a major axis of container 1101, in order to selectively cover or uncover aperture 1103. Lower surface of the lid 1102 meets the upper surface of the container 1101 at horizontal surface 1110 Aperture 1103 is substantially flush with horizontal surface 1110. Container 1101 includes a front portion 1106 which prevents excessive forward motion of lid 1102 once the aperture 1103 is substantially covered. Front portion 1106 includes a rearward-facing groove 1105 that mates with a lip 1104 on a front surface of lid 1102. Packaging unit 1100 is securely closed when lip 1104 mates with groove 1105.

FIG. 11B illustrates a right side sectional view of an alternate embodiment of a packaging unit 1150. Packaging unit 1150 has seal 1107 which is attached to a bottom side of lid 1108. The seal 1107 securely covers aperture 1103 when packaging unit 1150 is closed. The lid 1108 may be provided with a recess 1109 that at least partially encloses the seal 1107. The seal 1107 allows for a small clearance to be provided between container 1101 and lid 1108, providing reduced friction such that lid 1108 can be slid more easily to open and close packaging unit 1150.

Figure 12C:
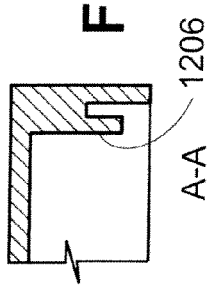
FIG. 12C shows a sectional view along A-A in accord with the embodiment of FIG. 12A.
Figure 12D:
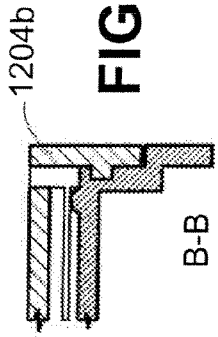
FIG. 12D shows a sectional view along B-B in accord with the embodiment of FIGS. 12A and 12B.
Figure 12E:
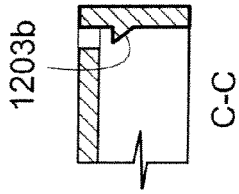
FIG. 12E shows a sectional view along C-C in accord with the embodiment of FIG. 12A.
Figure 12A:
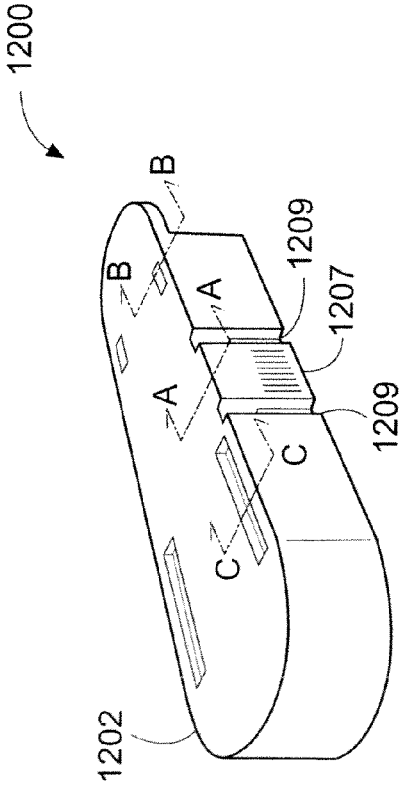
FIG. 12A shows a top rear left perspective view of an embodiment of a lid in accord with the invention.
Figure 12B:
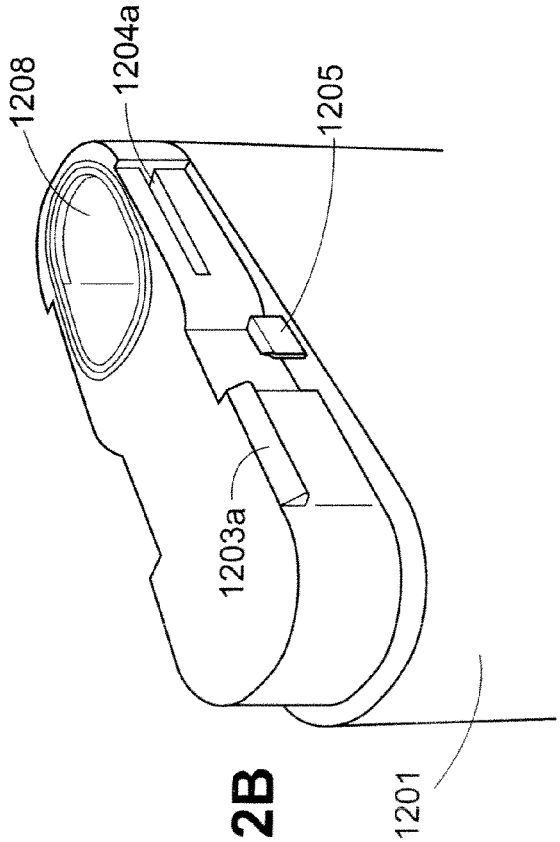
FIG. 12B shows a top rear left perspective view of an embodiment of a container in accord with the invention, configured to cooperate with the lid of FIG. 12A.

FIGS. 12A-12E illustrate an alternate embodiment of a packaging unit 1200. FIG. 12A is a top rear left perspective view of a lid. FIG. 12B is a top rear left perspective view of a container that cooperates with the lid of FIG. 12A. FIG. 12C is a sectional view of the lid along axis A-A shown in FIG. 12A. FIG. 12D is a sectional view of a mated lid and container along axis B-B shown in FIG. 12A. FIG. 12E is a sectional view of the lid along axis C-C shown in FIG. 12A. Container 1201 interfaces with lid 1202 by use of a first slidable attachment mechanism 1203*a*, 1203*b*, and a second slidable attachment mechanism 1204*a*, 1204*b*. The lid 1202 slides over the container 1201, along a major axis of container 1201, in order to selectively cover or uncover aperture 1208. The design of first and/or second slidable attachment mechanism may include a cooperating pair of rails, as shown for first slidable attachment mechanism 1203*a*, 1203*b*, and similarly in FIGS. 7-8. Alternatively, first and/or second slidable attachment mechanism may include a dovetail design or a cooperating tongue-in-groove design, as shown for second slidable attachment mechanism 1204*a*, 1204*b*. Embodiments of the invention are not limited in this regard, and other slidable attachment mechanism known in the art can be used, such that vertical motion is limited.

The side walls of lid 1202 include a tabbed portion 1207 that is cut on at least one side from the remainder of lid 1202, thereby forming a notch 1209 between tabbed portion 1207 and the remainder of lid 1202. The tabbed portion 1207 may be attached to lid 1202 along one edge of tabbed portion 1207 so as to create a springboard effect. FIG. 12C, which is a cross-section of tabbed portion 1207 along line A-A, illustrates that the inner side of tabbed portion 1207 includes a post 1206. When packaging unit 1200 is in a closed position, post 1206 cooperates with protrusion 1205 on an upper portion of container 1201 to prevent unwanted opening of packaging unit 1200. Protrusion 1205 includes cooperating blunt edges and tapered edges. Tabbed portion 1207 uses a lateral force to disengage post 1206 with protrusion 1205.

Figure 13:
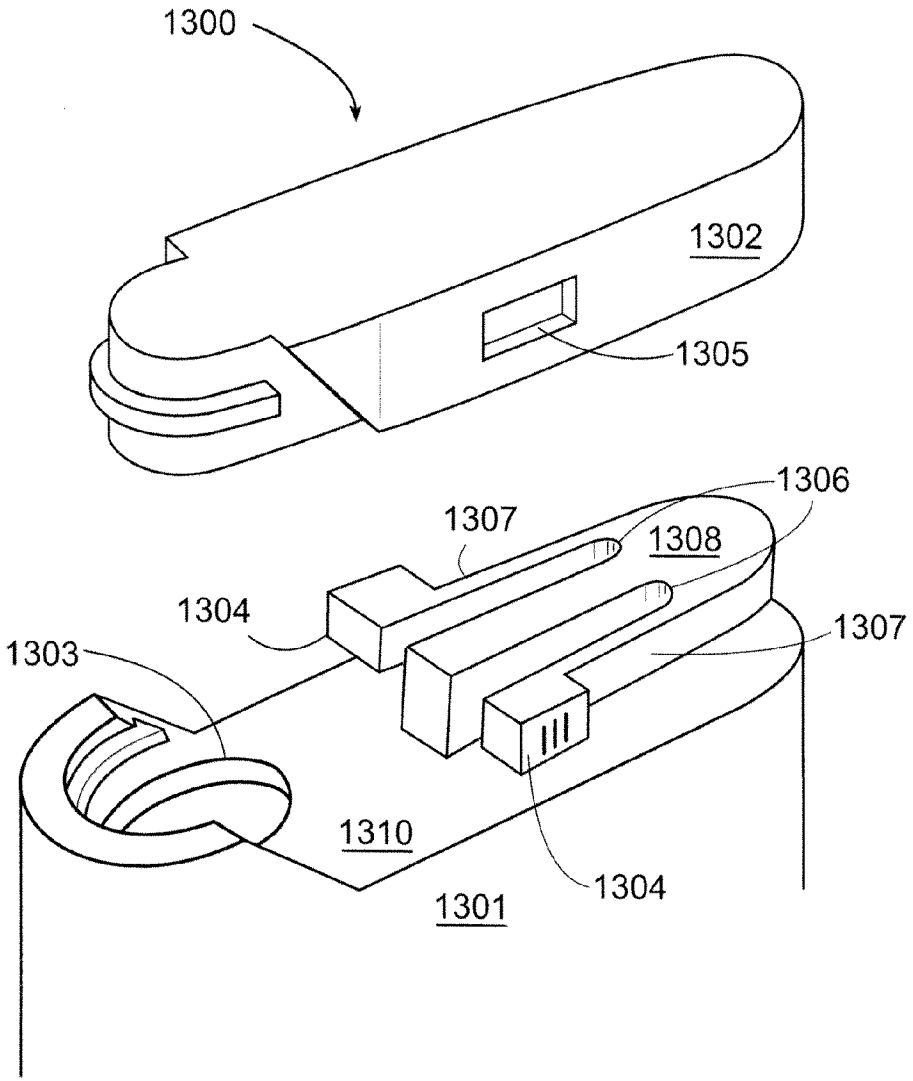
FIG. 13 show a top front right exploded perspective view of another embodiment of a child-resistant packaging unit in accord with the invention.

FIG. 13 illustrates an alternate embodiment of a packaging unit 1300. Container 1301 slidably interfaces with lid 1302 by use of cooperating slide and rail mechanisms (not shown in FIG. 13). Lid 1302 slides over container 1301, along a major axis of container 1301, in order to selectively cover or uncover aperture 1303. Container 1301 includes at least one arm 1307 disposed on the top surface 1310 of container 1301, the arm 1307 being oriented generally along the major axis. Arm 1307 is constructed from a resilient material that allows for a moderate amount of bending upon application of a moderate amount of pressure along the minor axis. An enlarged portion 1304 is disposed toward a forward end of arm 1307, the portion 1304 being enlarged in a direction substantially perpendicular to the travel axis. Enlarged portion 1304 for instance may be an outward protrusion as illustrated in FIG. 13.

The lid 1302 includes at least one aperture 1305 corresponding in position with the enlarged portion 1304. Enlarged portion 1304 cooperatively fits into aperture 1305 such that, when packaging unit 1300 is closed, lid 1302 is secured in a closed position over aperture 1303. Packaging unit 1300 is opened by squeezing enlarged portion 1304 inward until it is no longer within aperture 1305, then sliding lid 1302 along the travel axis away from aperture 1303. Advantageously, enlarged portion 1304 and aperture 1305 have cooperating blunt edges such that enlarged portion 1304 and aperture 1305 should not be disengaged and packaging unit 1300 opened without first squeezing inward enlarged portion 1304.

At an end opposite from enlarged portion 1304, arms 1307 are provided with a blocking structure 1306. Blocking structure 1306 may be formed, for instance, as an end of a slot formed up to a point where arm 1307 joins a center structure 1308, or where arm 1307 joins a complementary arm 1307 from the opposite lateral side of container 1301.

Figure 14:
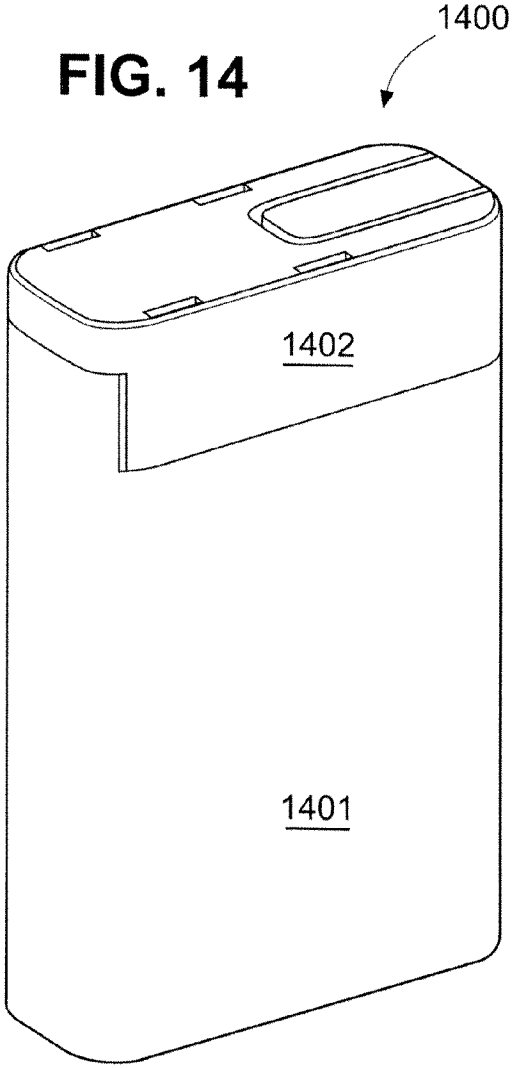
FIG. 14 show a top front right perspective view of another embodiment of a child-resistant packaging unit in accord with the invention.
Figure 15:
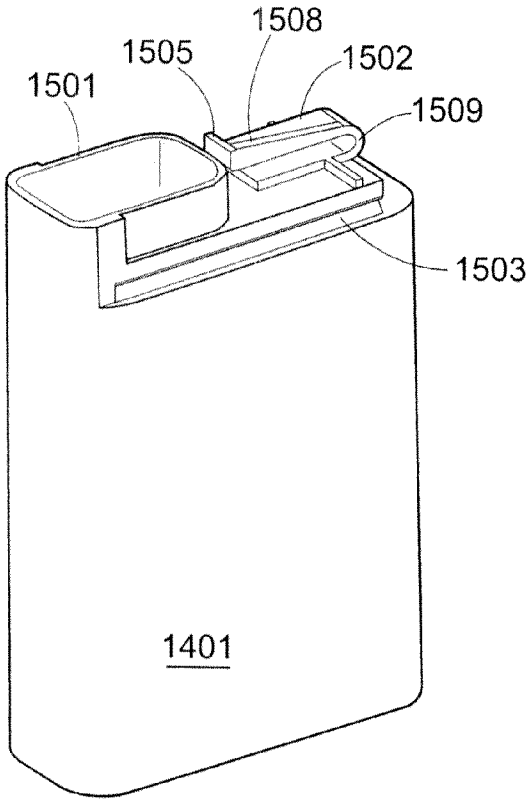
FIG. 15 show a top front right perspective view of the container in accord with the embodiment of FIG. 14.

FIG. 14 is a perspective view of an alternate embodiment of a packaging unit 1400 in a closed position. Packaging unit 1400 includes container 1401 and lid 1402. FIG. 15 is a top, front, right perspective view of container 1401 with lid 1402 removed. FIG. 15 depicts aperture 1501, arm 1502, and slideable mechanism 1503. Arm 1502 includes a vertically-oriented end face 1505 that may be blunt or substantially flat. Arm 1502 also includes an inclined surface 1508 on an upper side of arm 1502. Arm 1502 resiliently joins to a top surface of container 1401 at a pivot end 1509, such that arm 1502 can be pushed downward from a resting position to a depressed position by application of a moderate amount of downward pressure. Upon removal of the downward pressure, arm 1502 will rebound to substantially the resting position. Typically, when arm 1502 is in the resting position, protruding end face 1505 extends higher than a plane determined by the rim of aperture 1501. Inclined surface 1508 provides a smooth transition from pivot end 1509 to the upper tip of protruding end face 1505.

Figure 16:
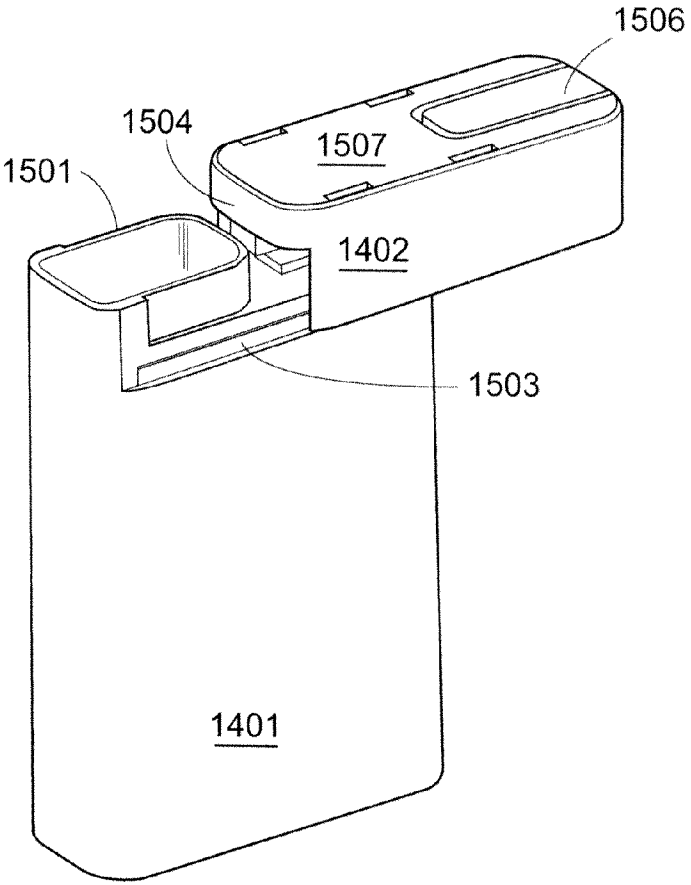
FIG. 16 show a top front right perspective view of the container and lid, with lid in open position, in accordance with the embodiment of FIG. 14.

FIG. 16 is a perspective view of packaging unit 1400 in an open position. Slide 1503 cooperates with a slideable mechanism (not shown) on the interior surface of lid 1402, such that lid 1402 can be slid along a travel axis relative to container 1401, while keeping lid 1402 substantially level and limiting vertical motion. Slide 1503 may include any of the structure described in connection with other embodiments, such as cooperating rails, dovetail, tongue-in-groove design, etc., as known in the art. Lid 1402 includes top surface 1507, which includes a tabbed portion 1506. Tabbed portion 1506 may include tactile and/or visual feedback such as ribs, slits, roughness, indentation, raised bump, rubberized spot, coloration, some material change or the like, to indicate to a user the location of the tabbed portion 1506. Tabbed portion 1506 is cut on at least one side from the remainder of lid 1402. Preferably, tabbed portion 1506 is attached to lid 1402 along one edge of tabbed portion 1506 so as to create a springboard. In one embodiment, the slideable mechanism is achieved using a pivot and external spring.

Figure 17:
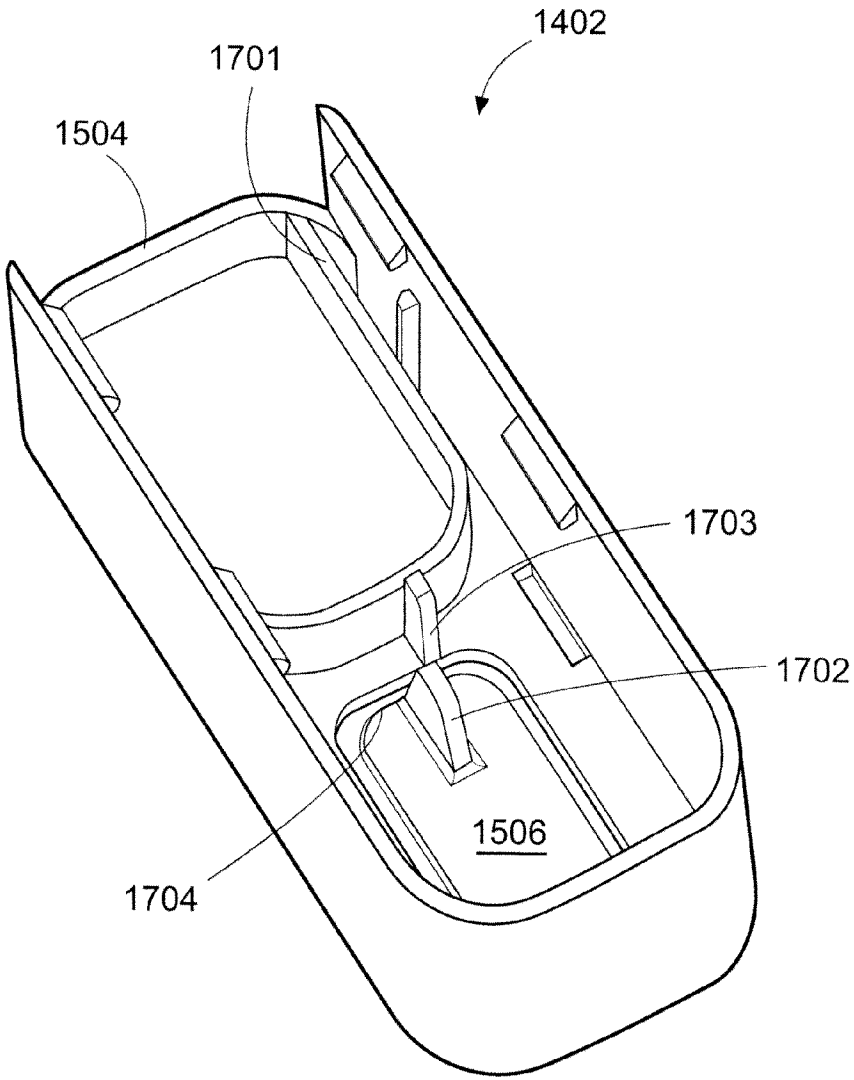
FIG. 17 shows a bottom perspective view of a lid in accord with the embodiment of FIG. 14.

FIG. 17 is a perspective view of the underside of lid 1402. Lid 1402 includes a circumferential wall 1701 configured to fit over the rim of aperture 1501 when lid 1402 is in a closed position, in order to keep the contents of container 1401 within container 1401. The bottom of tabbed portion 1506 includes a protrusion 1702 located near an end 1704 of tabbed portion 1506. The location of end 1704 is opposite from where tabbed portion 1506 is attached to lid 1402. When lid 1402 is in a closed position, protrusion 1702 is located opposing an end of arm 1502 distal from pivot end 1509. Lid 1402 also includes a stopping post 1703, located such that a gap approximately equal to the width of protruding end face 1505, in the direction of the major axis, is formed between stopping post 1703 and protrusion 1702. Front portion 1504 of lid 1402 is located at the front of lid 1402.

Figure 18:
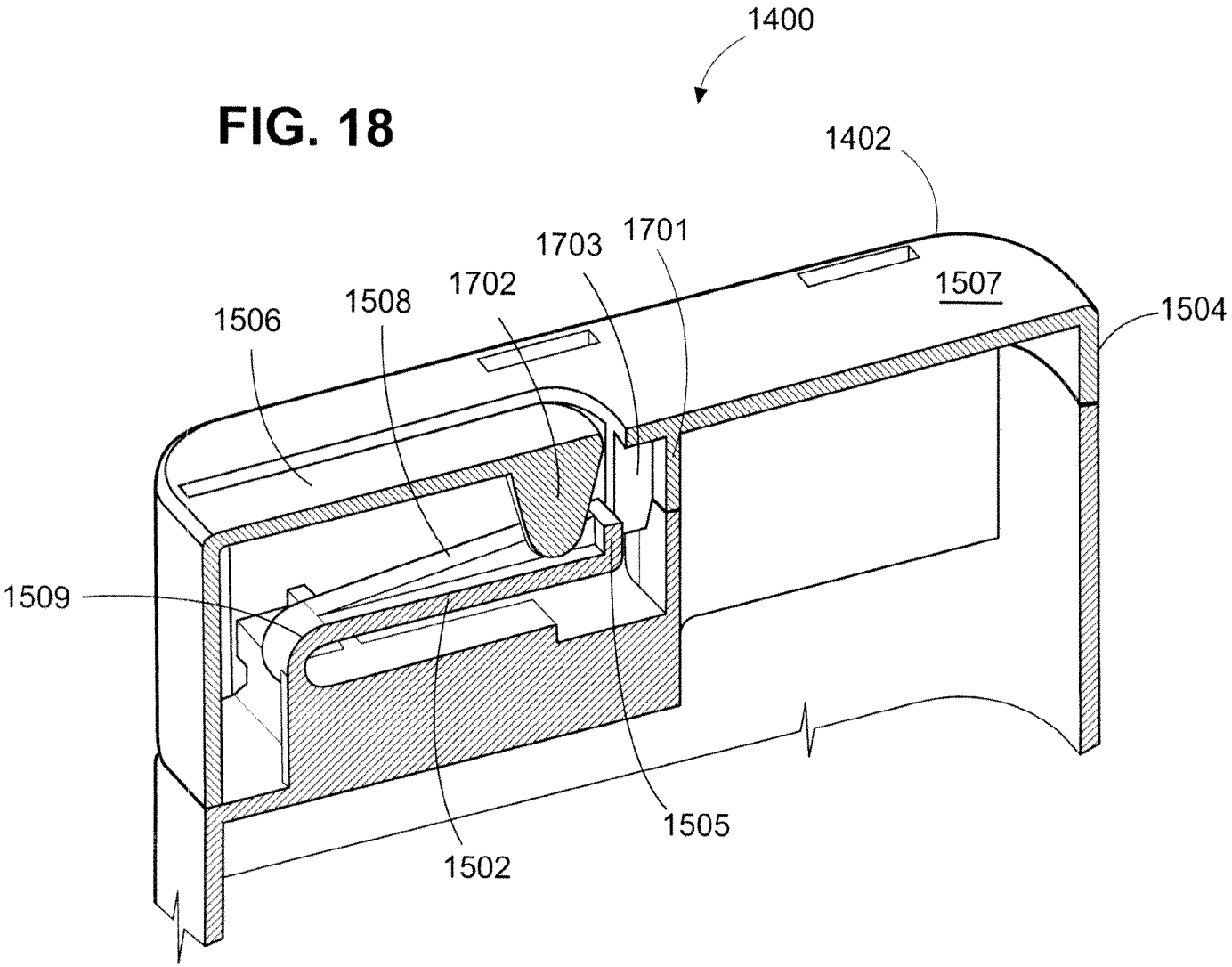
FIG. 18 shows a cutaway perspective view of the embodiment of FIG. 14.

FIG. 18 is a left perspective sectional view along the major axis of packaging unit 1400, shown in a closed position. Protruding end face 1505 of arm 1502 is nestled between protrusion 1702 and stopping post 1703 such that lid 1402 is prevented from opening, and the contents of packaging unit 1400 cannot be released.

To open packaging unit 1400, downward pressure on tabbed portion 1506 causes protrusion 1702 to transmit the downward motion to arm 1502, resiliently bending arm 1502 downward from a resting position to a depressed position. Once arm 1502 is sufficiently depressed, the upper tip of protruding end face 1505 will clear the lower tip of stopping post 1703, thereby allowing the lid 1402 to be slid rearward along the major axis of packaging unit 1400. Once the upper tip of protruding end face 1505 has cleared wall 1701, the upper tip of protruding end face 1505 will be inside the perimeter of wall 1701. When lid 1402 is slid sufficiently backward, protrusion 1702 will move past pivot end 1509 of arm 1502, and protrusion 1702 will no longer make contact with arm 1502, whereupon arm 1502 will resiliently rebound to its resting position. The resting position of arm 1502 is such that the upper tip of protruding end face 1505 will be higher than the lower edge of wall 1701, and higher than the lower edge of front portion 1504. As lid 1402 is slid further backward, protruding end face 1505 will make contact with lid 1402 at front portion 1504, thereby stopping any further backward movement. At this position, pivot end 1509 will be within the perimeter of wall 1701.

To close packaging unit 1400, the lid 1402 is slid forward relative to the container 1401. As pivot end 1509 begins to move past the perimeter of wall 1701, the inclined surface 1508 interacts with wall 1701 and/or stopping post 1703 in order to push arm 1502 downward from a resting position, thereby allowing protruding end face 1505 to pass under wall 1701 and stopping post 1703. When the lid 1402 is in a fully closed and locked position, the user may experience audible and/or tactile feedback (e.g., a click, snap, vibration, etc.) as protruding end face 1505 snaps into the nestled location between protrusion 1702 and stopping post 1703.

The embodiment of FIGS. 14-18 is conducive to operation with one hand by persons with sufficient manual dexterity. For instance, one finger (e.g., thumb or forefinger) can operate tabbed portion 1506 and slide lid 1402 backward, while the remaining fingers grasp container 1401.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. The invention is defined solely with regard to the claims appended hereto, and equivalents of the recitation therein.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

We claim:

1. A packaging unit comprising:

a container adapted to hold contents to be dispensed and having an aperture at an end thereof, the aperture being sized to dispense the contents therethrough;

a lid configured to slideably engage the container about the end thereof, the lid being slideable in a first direction between a closed position in which the lid covers the aperture and an open position in which the aperture is at least partially uncovered, wherein the container comprises a lip having a protrusion extending therefrom;

wherein the lid comprises:

a top wall;

a side wall extending from the top wall and including at least one resilient portion capable of being deflected in a direction substantially perpendicular to the first direction so as to disengage the lid from the container when in the closed position such that the lid is capable of sliding in the first direction to the open position; and a post extending from the top wall and being spaced apart from the side wall in a substantially parallel arrangement, the post being configured to engage the protrusion at a first position when the lid is in the closed position so as to limit opening of the lid along the first direction, and the post being further configured such that deflection of the at least one resilient portion displaces the post to a second position wherein the post is disengaged from the protrusion;

wherein the protrusion comprises a protrusion blunt surface and a protrusion tapered surface on opposite ends thereof, and the post comprises a post blunt surface and a post tapered surface on opposite ends thereof, wherein the protrusion blunt surface is configured to engage the post blunt surface at the first position; and wherein the lid comprises a linkage connecting the at least one post to the at least one resilient portion of the side wall, the linkage being configured to transmit deflection of the at least one resilient portion to the at least one post so as to be capable of displacing the post to the second position.

2. The packaging unit of claim 1, wherein the container comprises at least one rail disposed proximate to the end at which the lid is engaged, the at least one rail extending parallel to the first direction, the lid comprising at least one slide extending from the top wall and being configured to cooperate with the at least one rail during movement of the lid in the first direction.

3. The packaging unit of claim 2, wherein the container comprises a stopper extending from the lip thereof and arranged in an orientation substantially perpendicular to the slide, the stopper being configured to engage the at least one slide during movement of the lid in the first direction so as to limit movement of the lid in the first direction.

4. The packaging unit of claim 1, wherein the top wall of the lid comprises a catch and the container defines a recessed area, the catch and the recessed area being configured to cooperate to limit sliding of the lid beyond a predetermined limit.

5. The packaging unit of claim 1, wherein the lid comprises a top wall, a side wall extending from the top wall, a lip extending from the side wall, and a seal configured to overlie the aperture when the lid is in the closed position, and the container defining a groove configured to receive the lip when the lid is in the closed position.

6. The packaging unit of claim 1, wherein the lid comprises a top wall, a side wall extending from the top wall, and, a tabbed portion including a post and the at least one resilient portion, and the container further comprising a lip having a protrusion extending therefrom, the post being configured to cooperatively engage the protrusion to maintain the lid in the closed position.

7. The packaging unit of claim 6, further comprising at least one slidable attachment mechanism configured to facilitate sliding of the lid in the first direction along the container.

8. A method for dispensing a product, the method comprising: providing a product in a packaging unit of claim 1: imparting a force on the lid so as to deflect the at least one resilient portion of the side wall in a direction substantially perpendicular to the first direction to disengage the lid from the container; and simultaneously sliding the lid in the first direction during deflection of the at least one resilient portion such that the lid is moved to the open position and the aperture is at least partially uncovered.

* * * * *